United States Patent [19]

Winters et al.

[11] 3,994,280

[45] Nov. 30, 1976

[54] HORIZONTAL VENT AIR TERMINAL FOR SEALED COMBUSTION FURNACES

[75] Inventors: Mellie E. Winters; Perry E. Proctor, both of Wichita, Kans.

[73] Assignee: The Coleman Company, Inc., Wichita, Kans.

[22] Filed: Feb. 26, 1975

[21] Appl. No.: 553,098

[52] U.S. Cl. ..... 126/307 A; 98/46; 98/63; 98/71; 126/116 B; 126/85 B

[51] Int. Cl.[2] ..... F23J 11/00

[58] Field of Search ..... 126/85 R, 85 B, 116 B, 126/307 R, 307 A; 98/62, 63, 68, 71, 45, 46

[56] References Cited

UNITED STATES PATENTS

| | | | |
|---|---|---|---|
| 2,755,794 | 7/1956 | Wendell | 126/307 R |
| 2,998,764 | 9/1961 | Bedell et al. | 98/62 |
| 3,052,230 | 9/1962 | Conrad | 98/62 X |
| 3,327,609 | 6/1967 | Sage et al. | 98/62 |
| 3,490,352 | 1/1970 | Oehlschlaeger | 126/307 R |
| 3,643,646 | 2/1972 | Honaker, Jr. | 126/85 B |

*Primary Examiner*—William E. Wayner
*Assistant Examiner*—Ronald C. Capossela
*Attorney, Agent, or Firm*—Tilton, Fallon, Lungmus, Chestnut and Hill

[57] ABSTRACT

An air terminal for a horizontal vent of a sealed combustion furnace includes a faceplate for mounting to an exterior vertical wall. A horizontal flue pipe extension, receiving the combustion products, is surrounded by an oval sleeve. Fresh air is communicated to the furnace through the space between the flue pipe and the sleeve. The outlet of the flue pipe is at least about ¾ in. outside the faceplate. An enlarged fresh air intake opening exists about the flue pipe, and a pocket-shaped rain shield is located beneath the flue pipe extending upwardly and inwardly. A horizontal wind deflector vane is located beneath the flue pipe and extends across the width of the fresh air intake opening for directing incident wind downwardly along the wall. The terminal improves operation of the furnace under all wind conditions, whether the furnace is operating on pilot or main burner modes.

6 Claims, 9 Drawing Figures

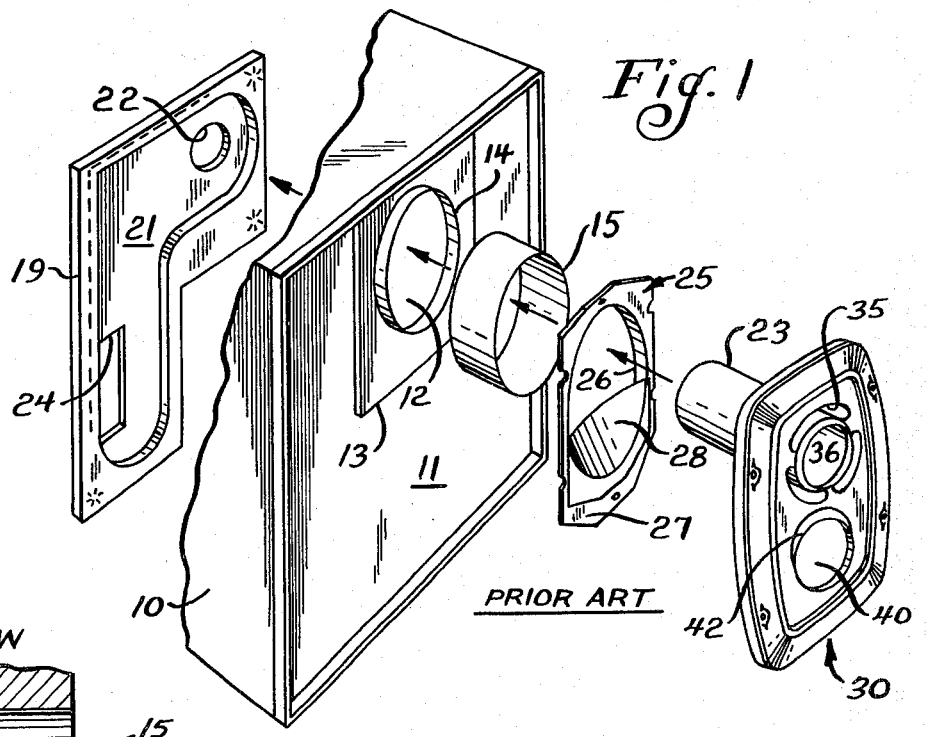
Fig. 1
Fig. 2
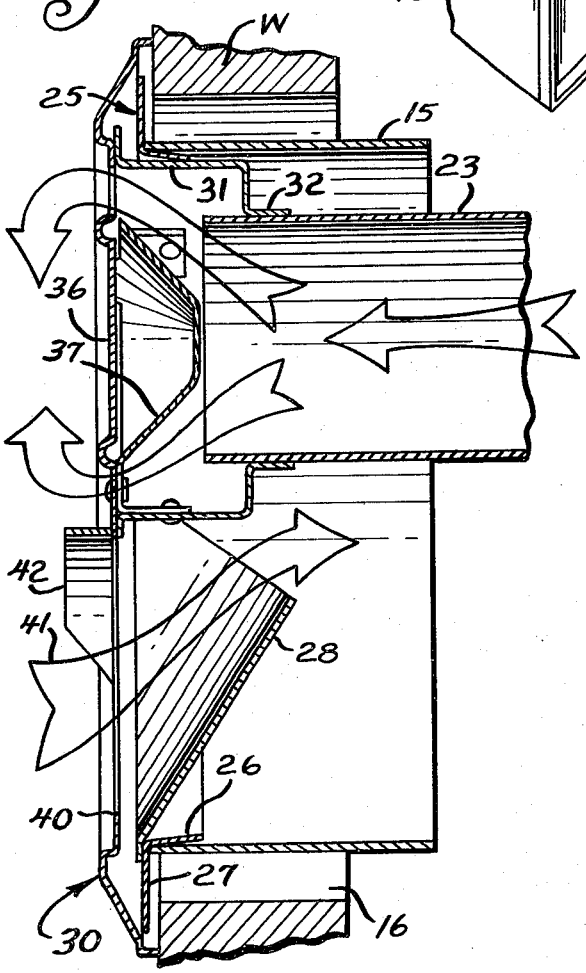
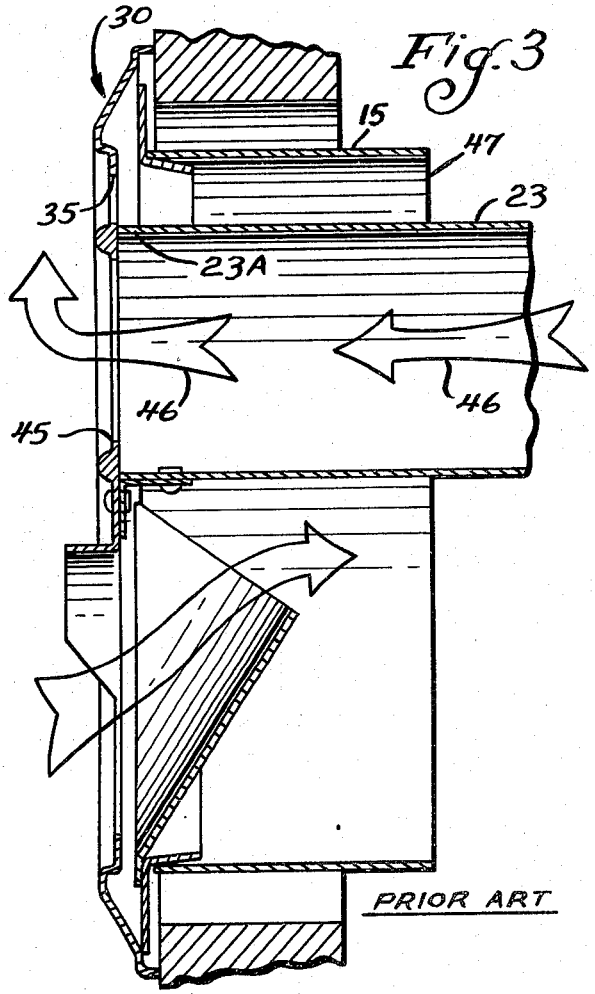
Fig. 3

4
11
21
23
23c
25
26
27
28
47
75
75A
76
77
78
79
80
82
83
84
84A
86
90
91
92
94
95
W
15

HORIZONTAL VENT AIR TERMINAL FOR SEALED COMBUSTION FURNACES

BACKGROUND AND SUMMARY

The present invention relates to sealed combustion furnaces—that is, furnaces in which the combustion air is taken from the atmosphere rather from the room or space being heated. More particularly, the present invention relates to a horizontal vent air terminal for sealed combustion furnaces.

The term "air terminal" refers to the terminal portion of the flue pipe and the location at which combustion air is drawn from the atmosphere. Since both conduits must pass through a vertical wall or a horizontal vent, it is desirable, to minimize installation costs, that they both pass through the same hole.

In furnaces of this type, it is necessary to achieve and maintain a properly balanced flow of combustion air into the system and flue products out of the system, while preventing the mixing and recirculation of flue products with fresh combustion air. In designing vent terminals capable of performing under incident wind conditions, prior practice has been to counteract or offset the effect of the wind in an attempt to simulate static operating conditions to maintain the critical balanced flow of intake air and combustion products. Previous test and industry-approved requirements for systems of this type did not require the maintenance of proper combustion characteristics (that is, requirements on carbon monoxide and carbon dioxide in the flue gases), under varying conditions. Rather, prior requirements were directed primarily to maintaining flame stability (that is, to prevent main burner flame or pilot flame outages) under varying wind conditions. Even with these requirements, prior designs of vent terminals for sealed combustion furnaces on recreational vehicles have proven suscepticle to standing pilot and main burner outages under various wind conditions; and this has been a continuing problem through the years, although in various degrees, as winds upset the critical system balance. The most common problem with vent terminals of this type is that an incident wind causes exhaust gases to splatter against the wall in all directions. Some of the splattered gas, therefore, must recirculate.

Another problem sometimes experienced in prior designs for sealed combustion systems, whether having an induced or a forced draft is that a standing pilot has been more susceptible to outage than in sealed combustion systems with a natural draft, for example, when venting through a roof. One of the reasons, of course, is that there is much less space, and hence, much less oxygen, available in an induced draft system than in a natural draft system. Such a pilot outage has occurred generally when the main burner is off so that the induced draft is not in operation, and the operation of the pilot is dependent primarily upon its ability to generate enough heat to create a natural draft and maintain a stable flame. During extremely cold weather, the ability of the pilot to generate sufficient heat to maintain a natural draft through a horizontal vent is, of course, reduced.

The reduced velocity of the pilot gases through a horizontal flue is not normally sufficient to cause pilot outage if the external vent terminal is not subjected to an incident wind. However, when the incident wind velocity exceeds 40 miles per hour or is in the range of below 10 miles per hour and the main burner is not operating, pilot outage may be caused by a blockage of the vent terminal, thereby suffocating the pilot as oxygen is consumed in the small burner cavity, or by recirculating flue products, further aggravating the problem of not having enough oxygen available to maintain a stable pilot.

The present invention represents an improved air terminal over that shown in the Honaker, U.S. Pat. No. 3,643,646, issued Feb. 22, 1972, entitled "Flue Exhaust and Combination Air Intake Assembly for Undercounter Furnace", and co-owned herewith. The stages of development will be more fully explained within for a better understanding of the structure and operation of each combination. However, previous air terminals exhibited certain disadvantages.

The previous air terminal which was actually manufactured (sometimes referred to as the "commercial" prior art) was somewhat different than the air terminal disclosed in the above-identified patent (sometimes referred to as the "patented" air terminal). Briefly, the patented air terminal employed a cone-shaped "frustum" located in front of the exhaust outlet of the flue pipe for creating turbulence in the exhaust gases after they were discharged; but this lack of directional flow of the exhaust gases became accentuated during high incident winds, resulting in a splattering of the gas and a recirculating of a portion of the exhaust gases. The amount of recirculation increased with incident wind velocity.

The commercial air vent improved the operation by eliminating the cone-shaped frustum and by extending the exhaust flue to a location approximately co-planar with the outer surface of the exterior wall through which the vent extended. This improved operation somewhat, in terms of reducing recirculation of flue gas, but, as will be explained within, the present invention is a significant improvement even over the commercial embodiment of the previous air terminal.

Briefly, the present invention provides an air terminal for a horizontal vent of a sealed combustion furnace which includes a faceplate mounted on the outside of an exterior vertical wall. A horizontal flue extension receives combustion products from the furnace and exhausts them to the atmosphere. An oval sleeve surrounds the flue extension, and fresh air is communicated to the furnace through the space between the flue pipe and the sleeve.

The outlet of the flue pipe is approximately ¾ in. beyond the faceplate or approximately 1 in. beyond the surface of the wall. The longer dimension of the oval sleeve extends vertically, and the flue pipe is located in the upper portion of it, held by tabs connecting the pipe to the air terminal, and by a horizontal wind deflector vane. Otherwise the fresh air intake opening conforms to the shape of the sleeve and in unobstructed.

A pocket-shaped rain shield is located beneath the flue pipe, and it extends upwardly and inwardly. The wind vane extends across the oval sleeve at approximately its midpoint and in front of the upper extension of the rain shield. The wind vane is designed to deflect incident wind downwardly in a substantially uniform manner parallel to the wall; and during high incident winds, it cooperates with the rain shield to deflect air downwardly along the lower portion of the fresh air intake opening and thence downwardly along the exterior wall.

For incident wind in the range up to 5 m.p.h., the operation of the inventive system is the same as for no wind—namely, the flue gases are delivered at a location spaced outwardly of the wall and travel upwardly due to their elevated temperature. The fresh combustion air is drawn through the aperture in the terminal plate beneath the wind vane, are deflected upwardly by the rain shield, and are delivered to the furnace through the space between the sleeve and the flue pipe. Somewhere in the range of 5–10 m.p.h. for incident wind, the operation of the system changes dramatically, as shown in smoke tests. That is, the exhaust gases are forced downwardly by the draft created by the wind vane, and fresh combustion air is taken in through the enlarged opening in the upper portion of the terminal plate.

As mentioned, this mode of operation for the improved air terminal of the present invention begins for incident wind velocities in the range of about 5–10 m.p.h., and it continues up to velocities over 40 miles per hour. The air flow is the same whether the furnace operates on pilot or on burner (that is, full burner operation) modes.

With the present invention, significant improvements have been observed in reducing the amount of carbon monoxide in the flue gas for all wind speeds. The improvement is particularly noticeable in relation to the prior commercial version of air terminal for wind speeds greater than about 5 m.p.h. Further, the present invention significantly controls the amount of carbon dioxide at a desirable efficiency level in the flue gas for all wind ranges, again, the improvement relative to the prior commercial version increasing with increased wind velocity.

Thus, the present invention provides significant advantages in maintaining acceptable levels of both carbon monoxide and carbon dioxide in the flue gas under main burner operation, and the improvement increases as the wind velocity increases. Further, because of the natural draft created in the system by incident wind, pilot outage has also been significantly reduced.

Other features and advantages of the present invention will be apparent from the following detailed description of the preferred embodiment accompanied by the attached drawing.

THE DRAWING

FIG. 1 is a partially cutaway perspective view of a vent terminal and furnace casing known in the prior art with the parts shown in exploded relation;

FIG. 2 is a vertical cross sectional view of the vent terminal shown in FIG. 1 with the parts in assembled relation;

FIG. 3 is a view similar to FIG. 2 of a commercial version of a prior art vent terminal;

DETAILED DESCRIPTION

Figures 4, 5, 6, 6A:
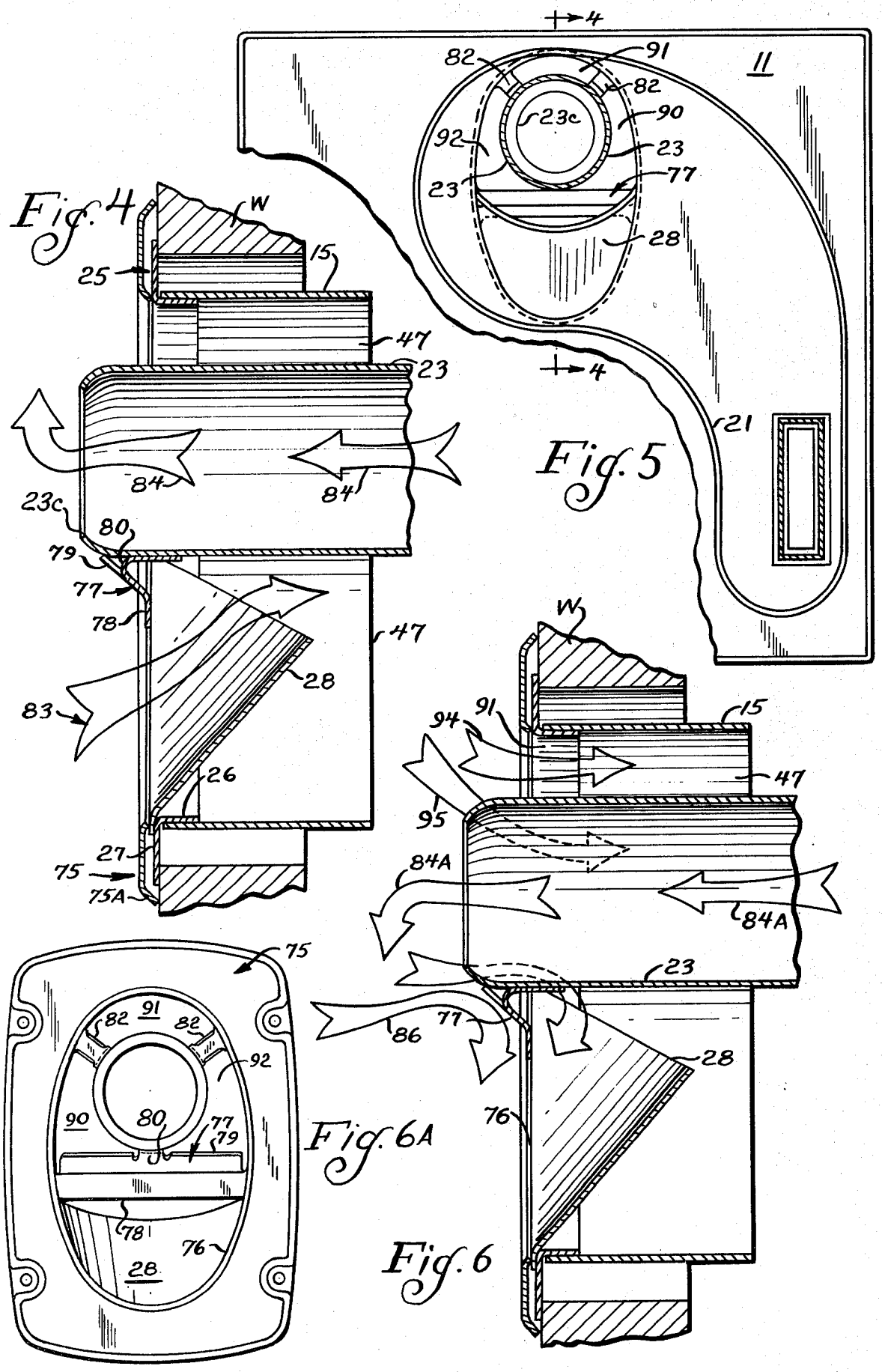
FIG. 4 is a view similar to FIGS. 2 and 3 but showing the inventive vent terminal.
FIG. 5 is an interior elevational view of the vent terminal of FIG. 4 assembled to a furnace casing.
FIG. 6 is a close-up view similar to FIG. 4 showing operation of the vent terminal under high incident wind conditions.
FIG. 6A is a perspective view of the inventive vent terminal.

Referring first to FIGS. 1 and 2, there is shown a vent terminal known in the prior art and disclosed in the above-identified U.S. Pat. No. 3,643,646. The casing of the furnace is designated by reference numeral 10, and it includes a rear wall 11 defining an oval-shaped aperture 12, the larger axis being oriented in the vertical direction. A plate 13 is welded to the outer surface of the wall 11, and it is provided with an outwardly extending flange 14 conforming to the shape of the aperture 12. A sleeve or collar 15 is received on the flange 14, and the sleeve 15 extends through a suitable opening 16 in an exterior wall of the space being heated, the wall being designated W in FIG. 2.

An L-shaped backplate 19 defining a boot-shaped recess 21 is welded to the interior of the rear wall 11 to provide a fresh air intake duct, in cooperation with the rear wall 11. The backplate 19 defines a round aperture 22 located directly behind the oval aperture 12 for receiving a round flue extension pipe 23. A rectangular lower aperture 24 is also provided in the recess 21 for communicating the fresh intake air for combustion to the inlet of a blower, not shown, but described more fully in the above-referenced patent.

The forward end of the sleeve 15 couples to a member 25 provided with a rearwardly extending flange 26 conforming to the shape of the sleeve 15. The member 25 also includes a vertical mounting flange 27 to which is attached a pocket-shaped rain shield 28.

An exterior vent hood or "terminal" is generally designated by reference numeral 30, and it is mounted directly to the wall W by means of screws, for example.

Referring particularly to FIG. 2, a support collar 31 is welded to the rear of the terminal plate 30, and includes a reduced annular flange 32 which supports the distal end of the exhaust flue 23. It will be observed that the exhaust flue 23 terminates in a plane located inside of the plane defined by the outer surface of the wall W.

The terminal plate 30 is provided with a three-segment curved or slotted exhaust opening generally designated by reference numeral 35, the center portion of which is closed by means of a plate 36. Behind the plate 36 there is mounted a frusto-conical shaped member 37 (sometimes referred to as a "frustum") for directing the exhausting flue gases to the exhaust slots 35.

The lower central portion of the terminal plate 30 is provided with a round opening 40 for receiving intake combustion air in the direction of the arrow 41. A circular hood 42 is located above the opening 40, and it extends outwardly a short distance from the terminal plate 30 to assist in isolating exhaust gases from fresh combustion air.

The vent hood of FIGS. 1 and 2 was designed to operate as shown in FIG. 2. That is, the frustum 37 was designed to create an exterior low pressure area immediately outside of the central plate 36 to divert the exhausting flue gases toward the center where they would mix with atmospheric air and due to the elevated temperature of the exhaust gases, would rise above and therefore be separated from the fresh combustion air. However, even minor incident wind velocities caused the flue gases to mix with the fresh combustion air due to the scattering of the flue gases against the terminal plate. This operation was exaggerated because of the non-directionality of the flue gases in the low-pressure zone in front of the plate 36.

Hence, in the commercial embodiment shown in FIG. 3, the exhaust flue 23 was extended as at 23A to connect with the terminal plate 30. The plate 36 and frustum 37 were eliminated, and a central exhaust aperture 45 was formed so that exhaust gases could exit axially of the exhaust flue 23 in the direction of the arrows 46 until they were permitted to rise after exit. Further, the collar 31 was eliminated so that the slots 35 communicate directly with the space 47 between the oval sleeve and the exhaust flue 23. Again, however, it was observed that the amount of carbon monoxide and carbon dioxide increased with an increase in incident wind velocity. In the case of carbon monoxide, as can be seen by the curve 100 of FIG. 8, the amount of recirculated carbon monoxide increased rapidly as incident wind velocity increased, whereas for carbon dioxide, the volume increased steadily up to velocities of 20 –25 miles per hour, then dipped slightly to 30 miles per hour, and then began to rise again until, as indicated by the point 49 on the curve 50, both the main burner and pilot extinguished.

Turning now to the illustrated system which incorporates the invention, this specific embodiment is only illustrative, and persons skilled in the art will readily appreciate the broader aspects of the invention. Thus, there is included an oval-shaped sleeve 15 which seals with the rear wall 11 of a furnace casing and extends outwardly thereof. The distal end of the sleeve 15 connects to a flange member 25 which may be similar to the one discussed above including a rearwardly extending oval connecting flange 26 and a vertical mounting flange 27. A pocket-shaped rain shield 28 is connected to the member 25.

The faceplate for the improved vent terminal is designated by reference numeral 75, and it includes an enlarged oval-shaped aperture 76 of the same general shape and orientation as the sleeve 15 and acts as a continuation of the space 47 between the sleeve 15 and the exhaust flue 23. A wind-deflector vane generally designated 77 is located approximately at the midpoint of the longer dimension of the opening 76, and extends across the opening, as seen in FIG. 6A. The deflector vane 77 includes a generally vertical strip portion 78 at the top of which there is located an inclined portion 79, extending upwardly and outwardly thereof to a point adjacent the outlet 23C of the exhaust flue 23. It will be observed that the outlet end of the exhaust flue 23 is curved inwardly to provide a reduced exhaust opening 23C. The center of the inclined portion 79 of the deflector vane 77 is curved rearwardly as at 80 to define a tab which is welded to the lower portion of the exhaust flue 23. The exhaust flue is further secured by means of straps 82 located approximately at the 2 o'clock positions of FIG. 6A, considering the axis of the exhaust flue 23 as the center.

It will thus be observed that in the embodiment of FIGS. 4–6A, the opening in the faceplate 75 above the deflector vane 77 has been enlarged substantially, comprising three generally wedge-shaped portions designated respectively 90, 91 and 92. In one embodiment (i.e., for a furnace of particular capacity), the total area of the three wedge-shaped openings 90, 91, 92 comprises approximately 6 square inches, and represents an increase of about 260 percent over the curved slots of the prior art embodiment of FIGS. 1–3. It will be observed further that the openings 90, 91, 92 communicate directly with the annular space 47 between the exhaust flue 23 and the oval sleeve 15. Further, the opening beneath the deflector vane 77 has also been enlarged to conform to the cross sectional shape of the sleeve 15.

The rain shield or deflector 28 in the inventive combination performs the known function of dispelling rain which would otherwise enter the air intake assembly. However, in addition, it acts in cooperation with the air directing vane 77 to continue the flow of downwardly-directed excess air under the influence of incident wind. Finally, in static conditions, it directs the flow of fresh combustion air upwardly into the space between the sleeve 15 and flue pipe 23 at a location spaced well inwardly of the distal end of the flue pipe, thereby enhancing separation of flue products and combustion air.

Referrng now particularly to FIG. 4, the distal end of the exhaust flue 23 has been extended outwardly beyond the terminal plate 75. Preferably, the distance between the terminal plate 75 and the distal end of the exhaust flue 23 is about ¾ in. The terminal plate 75 has a beveled peripheral edge 75A, so tht the overall thickness is approximately ¼ in., leaving the distance of the distal end of the exhaust flue 23 approximately 1 in. beyond the outer surface of the wall W.

OPERATION

Under conditions of no wind, both in the main burner mode and the pilot mode of operation, combustion air is delivered through the lower portion of the oval intake air opening 76 in the direction of the arrow 83, the intake air then travels in the space 47 to the combustion chamber. The hot flue gases travel in the direction of the arrows 84 and are delivered through the opening 23C at a location about 1 in. beyond the outer surface of the wall W, where they rise because they are heated. When the burner is turned on and the draft is forced, as mentioned, the directional pattern of intake and exhaust flow remains the same, the volume merely increasing.

This same flow pattern for intake air and flue gases remains substantially unchanged under conditions of low incident wind up until the incident wind velocity reaches the range of 5–10 miles per hour. At some point in this range, the flow pattern changes rapidly and dramatically to that illustrated in FIG. 6. That is, the incident wind represented by the arrow 86 is deflected downwardly by the deflector vane 77. There results a uniform downward flow of this incident air, and it increases as the velocity of the incident air increases, thereby creating a low pressure area immediately behind the deflector vane 77, and this, in turn, causes air entering the openings 90 and 92 above the deflector vane 77 to course around the distal end of the exhaust flue 23 and over the rain shield 28 and then out through the lower portion of the opening 76. Thus, a downward wind flow is established for excess air. Further, the direction of the flue gases abruptly changes to a downward flow, as indicated by the arrows 84A. This is not a scattering distribution as experienced in the prior structures mentioned above. Rather, it is a substantially uniform downward flow which is separated from the wall W by the downwardly directed flow of incident wind. It is believed that this separation or outward spacing of the flue gases under high incident wind is enhanced by the delivery of the flue gases to the location spaced outwardly from the wall W, as disclosed above.

The fresh intake combustion air, under conditions of high incident wind being discussed, flows through the upper opening 91 (as indicated by arrow 94) and through the upper portions of the openings 90, 92 (as indicated by the arrow 95) into the space 47 between the sleeve 15 and the flue pipe 23.

The present invention thus departs from the prior art that has been mentioned by using incident wind to advantage to create a uniform downward flow of excess air, which flow increases as the velocity of the incident wind increases. This is in contradistinction to the prior attempts to counteract the effect of the incident wind which, in some cases, resulted in a choking of the vent system, particularly under pilot conditions. The result of the present invention, then, is to use the incident wind pressure to maintain a proper flow of air into the system and, as the wind velocity is increased, to direct excess air in a controlled manner to insure the separation of flue products and combustion air.

Figure 7:
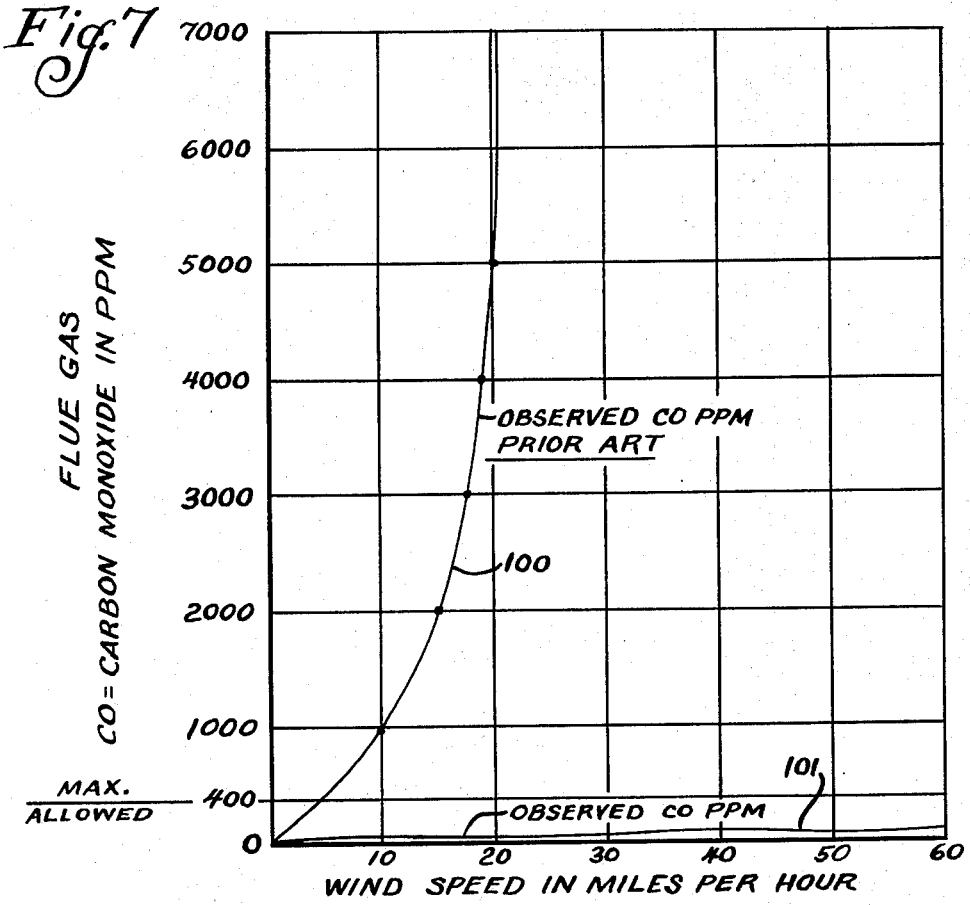
FIG. 7 is a graph showing comparative results in the amount of carbon monoxide present in flue gas under various wind conditions between the embodiments of FIG. 3 and FIGS. 4–6A.
Figure 8:
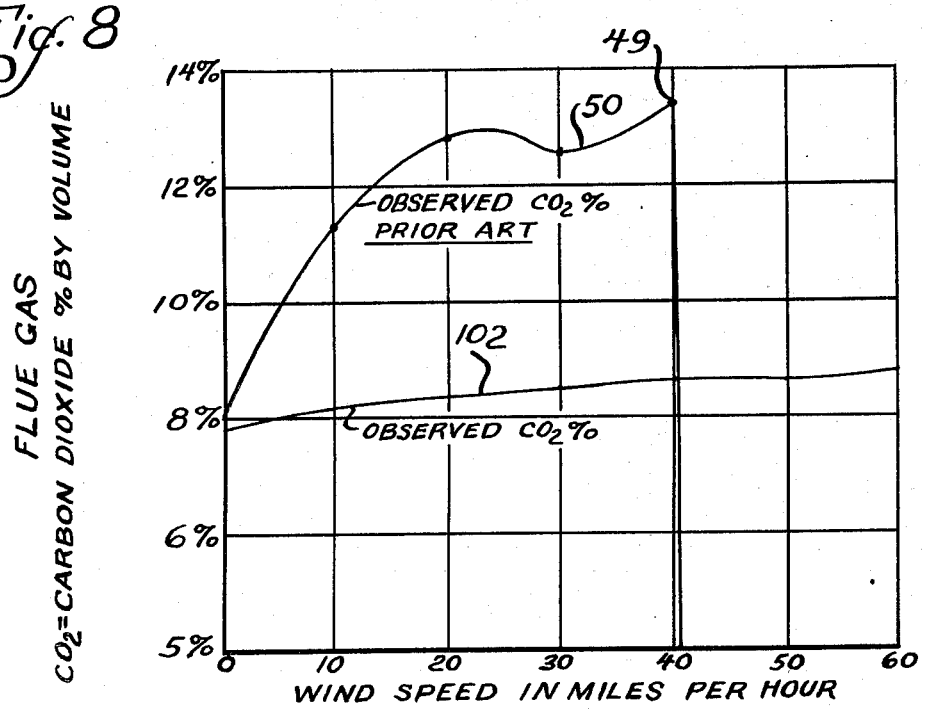
FIG. 8 is a graph showing comparative results in the amount of carbon dioxide present in the flue gas for various wind conditions for the embodiments of FIG. 3 and FIGS. 4–6A.

Referring now to FIGS. 7 and 8, there are shown comparative results between one particular design incorporation the invention (namely, the one illustrated and described above) and the above-referenced prior commercial embodiment (FIG. 3). Even though the values on the graphs represent this particular design, it will be appreciated that the improved results could equally be obtained for modifications as long as the principles of the invention are followed. Turning, then to FIG. 7 first reference numeral 100 represents the relationship of the amount of carbon monoxide in parts per million (ordinate) in the flue gas as a function of incident wind velocity for the commercial embodiment of FIG. 3. Reference numeral 101 represents the corresponding curve for the inventive system. The value 400 is the maximum allowed under current industry regulations. From FIG. 7, it will be observed first that the presence of carbon monoxide in the flue gas for the prior art system increased dramatically with incident wind velocity, exceeding the 400 parts per million level at about 5 miles per hour of incident wind velocity, and secondly, that the amount of carbon monoxide in the inventive system remains at a rather low level throughout the range illustrated.

In FIG. 8, reference numeral 102 shows the relationship between the amount of carbon dioxide (percent by volume) as a function of incident wind velocity for the improved system; whereas, as discussed above, the curve 50 shows the same relationship for the prior commercial system described above. Again, there is substantial improvement in the system illustrated in FIGS. 4–6A which operates satisfactorily well beyond the range at which the earlier system ceases to function. In the improved system, the carbon dioxide is held at a desirable level for wind velocities up to 40 miles per hour.

Having thus disclosed in detail a preferred embodiment of the present invention, persons skilled in the art will be able to modify certain of the structure which has been illustrated and to substitute equivalent elements for those disclosed while containuing to practice the principle of the invention; and it is, therefore, intended that all such modifications and substitutions be covered as they are embraced within the spirit and scope of the appended claims.

We claim:

1. An improved air terminal for horizontally venting a furnace through an opening in an upright wall comprising: a sleeve extending through said opening in said wall and adapted to be connected at its inner end to a furnace casing; a flue pipe within said sleeve and extending therethrough for communicating flue products to the atmosphere, the outermost ends of said flue pipe extending beyond the outer surface of said wall for delivering said combustion products at a location spaced outwardly of the exterior surface of said wall, said flue pipe being spaced inwardly of said sleeve to define a space about said flue pipe for delivering combustion air to a furnace; a terminal plate adapted to be mounted to said wall to cover said opening and defining an aperture conforming to the cross sectional shape of said sleeve; rain shield means located in the bottom portion of said opening in said terminal plate beneath said flue pipe for deflecting incident rain outside of said wall; and a wind vane means carried by said terminal plate and spaced forwardly of the upper portion of said rain shield, and extending across the opening therein beneath said flue pipe for directing incident wind downwardly and parallel to the outer surface of said wall to thereby draw at least some of the incident wind coursing above said wind vane means downwardly behind said vane means and in front of the rain shield.

2. The apparatus of claim 1 wherein said sleeve has an oval cross sectional shape and wherein said flue pipe is located in the upper portion of said sleeve.

3. The apparatus of claim 1 further comprising tab means for mounting said flue pipe to said terminal plate.

4. The apparatus of claim 1 wherein said wind vane means includes a vertically oriented strip extending from side to side across said opening in said terminal plate and an inclined portion extending upwardly and outwardly from said vertical portion to a location beneath the distal end of said flue pipe, thereby to generate a low pressure area therebehind for causing incident wind entering said opening above said wind vane means to course around the rear portion thereof and thence be directed downwardly and out the lower portion of said opening in said terminal plate.

5. The apparatus of claim 4 characterized in that the upper portion of said opening in said terminal plate is obstruction-free above said wind vane means except for said tab means, thereby to define an enlarged inlet opening to receive combustion air under conditions of high incident wind, said apparatus being characterized under conditions of high incident wind to receive substantially all combustion air through sid terminal plate opening above said wind vane means and further characterized in that the amount of carbon monoxide in the flue gas does not exceed 400 parts per million for wind velocities in the range of 0—40 miles per hour.

6. In an air terminal assembly for horizontally venting furnaces through an opening in an upright wall including a sleeve extending through said opening, a terminal plate covering said opening, a rain shield in the lower portion of said terminal plate and a flue pipe extending through said sleeve, the improvement characterized by said flue pipe's extending a distance of at least about 1 in. beyond the outer surface of said wall for delivering flue gases at a location spaced outwardly of said wall, said terminal plate defining an opening conforming substantially to the shape of said sleeve, a wind vane extending across said terminal plate opening beneath said flue pipe and including an inclined portion extending downwardly and rearwardly from a location beneath the distal end of said flue pipe and a vertical portion extending downwardly from the lower end of said inclined portion, and characterised in an enlarged, substantially obstruction-free opening about said flue pipe above said deflector vane, said apparatus further being characterized in that for incident wind velocities above the range 5–10 miles per hour, the flue gases are forced and delivered in substantially uniform flow in a downward direction caused by the deflection of incident wind by said wind vane.

* * * * *